United States Patent [19]

Stout

[11] Patent Number: 4,770,554

[45] Date of Patent: Sep. 13, 1988

[54] RIBBON DRIVE WITH INVERTIBLE GEAR FOR PRINTER RIBBON CARTRIDGE

[75] Inventor: Gordon Stout, Berkeley, Calif.

[73] Assignee: Wordex Corporation, San Leandro, Calif.

[21] Appl. No.: 923,944

[22] Filed: Oct. 28, 1986

[51] Int. Cl.[4] ..... B41J 33/26

[52] U.S. Cl. ..... 400/235.1; 400/227.2; 400/208

[58] Field of Search ..... 400/208, 208.1, 227.2, 400/234, 235, 235.1, 236, 236.1, 236.2

[56] References Cited

U.S. PATENT DOCUMENTS

| | | | |
|---|---|---|---|
| 4,231,667 | 11/1980 | Behrendt | 400/227.2 |
| 4,307,969 | 12/1981 | Daughters | 400/235.1 |
| 4,353,658 | 10/1982 | Craft | 400/236.2 |
| 4,400,103 | 8/1983 | Daughters | 400/235.1 |
| 4,490,059 | 12/1984 | Daughters | 400/235.1 |

FOREIGN PATENT DOCUMENTS

| | | | |
|---|---|---|---|
| 162682 | 12/1981 | Japan | 400/236 |
| 73984 | 4/1984 | Japan | 400/235.1 |

OTHER PUBLICATIONS

"Ribbon Drive"; D. P. Darwin; IBM Technical Disclosure Bulletin; vol. 19, No. 4, pp. 1407–1408.

R. D. Chenoweth et al; "Print Ribbon Stripper"; *IBM Tech. Disc. Bull.;* vol. 13, No. 8, p. 2235; Jan. 1971.

*Primary Examiner*—David A. Wiecking

*Attorney, Agent, or Firm*—Townsend and Townsend

[57] ABSTRACT

A cartridge is provided with an improved drive which meters ribbon to a constant and selected rate of ribbon advance. At least one ribbon drive cylinder is provided around which the ribbon is wrapped. The drive cylinder is preferably a rubber cylinder of selected diameter constituting a force fitted sleeve on a metering gear. Provision is made for a single but reversible coaxial small and large gear pair to mount at two different locations in the cartridge between a driven gear and the metering gear. The coaxial gears include a first large diameter gear with a greater number of teeth and a smaller diameter gear with a lesser number of teeth. By assembling the large gear in mesh the drive gear and the small gear in mesh with metering cylinder gear, ribbon speed is reduced. The ribbon can be moved at a low speed such as required in multi-strike ribbon applications. By inverting the gear and assembling it in a second location with the small gear driven by the drive gear and the large gear driving the metering gear, ribbon speed is increased. The ribbon can be moved at a high speed such as required in single strike applications. The metering gear is typically threaded with rubber sleeves of various diameters to permit ribbon speed to be precisely tailored to either ribbon or printer requirement.

1 Claim, 5 Drawing Sheets

RIBBON DRIVE WITH INVERTIBLE GEAR FOR PRINTER RIBBON CARTRIDGE

This invention relates to printer ribbon cartridges and more particularly to improved drive mechanisms utilized with printer cartridges.

SUMMARY OF THE PRIOR ART

Printer cartridges generally consist of a spirally wound supply ribbon pancake, a spirally wound take-up ribbon pancake and metering gears for moving ribbon from the supply pancake to the take-up pancake, at a desired rate of speed. Typically, the metering gears include first and second meshing gears or rollers trapping and feeding the ribbon therebetween. Such metering gear arrangements with gears meshing over the ribbon have many difficulties.

First, there is unpredictable ribbon slippage as the ribbon is pulled between the meshing gears of the gear metering apparatus. Typically this is due to the fact that the ribbon occupies a serpentine path between the meshed gears, and the ribbon must slip as it moves through the gear mesh. Depending on where the slippage occurs, the ribbon may move faster or slower than the pitch line speed of the metering gears. Consequently, the passage of the ribbon at the printer head likewise varies from the desired speed.

Contributing to this difficulty is variation in both the supply ribbon tension and the take-up ribbon tension. The supply ribbon tension typically varies dependent upon the diameter of the supply ribbon pancake. Typically this force is low when ribbon is first dispensed because of the large diameter of the ribbon pancake. It is relatively high when the ribbon is finally dispensed because of the small diameter of the ribbon pancake.

The ribbon take-up pancake is subject to even more variation. Typically, in order to assure that ribbon take-up occurs, a belt from one of the metering gears drives the take-up pancake. Since the metering gears typically rotate faster than the take-up pancake, slippage occurs at the belt, which results in a constant torque characteristic for the take-up pancake drive.

Unfortunately, when the cartridge is first used, the diameter of the take-up pancake is small. Consequently, the take-up tension on the ribbon is large. As the cartridge nears the end of the ribbon, the take-up pancake is large and the take-up tension is therefore small.

These variations in supply and take-up tension tend to produce ribbon slippage at the metering gear in different directions at the beginning and end of the ribbon life. Near the start, the low supply side tension and high take-up tension tend to pull ribbon too fast through the metering gears. Near the end, the high supply side tension and low take-up tension tend to retard ribbon motion through the metering gears.

In order to minimize slippage and maintain accurate metering, springs have been used to squeeze the metering gears together to grip the ribbon more positively. These springs typically create several problems: they are a costly extra part, especially if they are made of metal; especially if they are made of plastic, they tend to relax their clamping force with time and hence allow ribbon slippage; if the springs are stiff, close manufacturing tolerances are required to ensure the correct force; and the clamping together of the metering gears increases the torque required to drive the cartridge.

It is known that torque for driving the ribbon in such cartridges must be held to a minimum. As the ribbon driving motors of printers lose the ability to apply torque for the advancement of ribbon, ribbon cartridges are frequently rejected in number before the printer is sent out for repair. By having a low torque ribbon cartridge, a manufacturer of ribbon cartridges can assure a lower rejection rate, especially where the ribbon driving torque provided by a significant number of printers is minimal.

Another problem of gear mesh drives is that the gear teeth cause the ribbon to become folded in an accordian-like pattern. This accordian-like pattern when wound about the take-up pancake causes that pancake to occupy a diameter larger than it would be if the ribbon were flat. Consequently, the amount of ribbon that the cartridge may hold and maintain is limited.

Moreover, ribbons have been driven between paired rollers without gears, the rollers pinching the tape as it passes there between. Though the roller drives do not have the slippage problems caused by the serpentine ribbon path through gear mesh drives, they do have similar problems of slippage, squeezing force, springs, close tolerances, and high torque discussed above in relation to gear mesh drives.

Finally, such drives in the past have been provided with molded gears providing a constant drive ratio. Unfortunately, different kinds of ribbon (with, for example, different overstrike characteristics) or different printer parameters may require different ribbon metering rates. Where the gears are injection molded, new or altered molds have in the past been required to be made to obtain different rates of advance.

SUMMARY OF THE INVENTION

A cartridge is provided with an improved drive which meters ribbon at a desired rate of advance. At least one ribbon drive cylinder is provided around which the ribbon is wrapped for a sufficient angle to provide drive traction from the friction of the ribbon against the cylinder.

According to well-known engineering principles, the ribbon will not slip relative to the drive cylinder or cylinders unless the ratio of the tension tending to cause slippage to the tension tending to resist slippage exceeds a certain amount. This ratio depends primarily on the coefficient of friction of the ribbon against the cylinder, and the angle of wrap of the ribbon around the cylinder; a ratio high enough to prevent slippage may be achieved by choosing a sufficiently large angle of wrap for the coefficient of friction of the ribbon against the cylinder.

With this method of driving a ribbon cartridge, a relatively small amount of tension from the take-up pancake can enable the metering cylinder to provide a large driving tension without slippage occurring, and hence provide the desired metering rate despite variations in the ribbon supply tension. Similarly, a relatively small amount of supply side tension can enable the ribbon to resist slipping relative to the metering cylinder despite a large take-up tension. This main metering force thus overcomes variations in either rates of take-up or ribbon tensions from either the ribbon supply pancake or the ribbon take-up pancake.

Provision is also made for a single but reversible coaxial small and large gear pair to mount at two different locations in the cartridge between the metering gear and a drive gear driven by the printer. The coaxial gears include a first large diameter gear with a greater number of teeth and a smaller diameter gear with a lesser number of teeth. By the expedient of assembling the cartridge with the large gear mounted to the drive gear and the small gear to the metering gear, ribbon speed is reduced. The ribbon can be moved at a low speed as required in multi-strike ribbon applications. By the expedient of assembling the gear inverted and mounted in a second location with the small gear driven by the drive gear and the large gear driving the metering gear, ribbon speed is increased. The ribbon can be moved at a high speed as required in single strike applications. The metering cylinder may be threaded with rubber sleeves of various diameters to permit ribbon speed to be precisely tailored to special ribbon or printer requirements.

Alternatively the drive may be by several cylinders of lower friction materials, geared together so that the peripheral speed is similar. This allows a greater angle of wrap of the ribbon around the drive cylinder, which gives sufficiently high drive traction despite the low-friction materials.

OTHER OBJECTS, FEATURES, AND ADVANTAGES

An object of this invention is to disclose a ribbon drive whose controlling metering force is provided by wrapping the ribbon around at least one driving cylinder. A prior art tape cartridge having a supply pancake, ribbon pancake and a take-up ribbon pancake is modified. Typically, ribbon supplied to the printer passes out a supply arm, across a printer head, and into a take-up arm. In the path between the entrance to the take-up arm and the take-up ribbon pancake, there is provided a belt pulley ribbon drive. Typically, operating tension is provided to the belt pulley drive by the take-up pancake which is driven by a driving belt on the exterior of the cartridge. The ribbon winds around a portion of at least one high friction metering cylinder on a circumferential path. There results a drive traction which overcomes all other ribbon driving forces including supply tension and take-up tension.

An advantage of the disclosed drive is that it advances ribbon with little or no slippage. Consequently, ribbon is driven at the desired metered rate.

Yet another advantage of this invention is that driving torque applied to the ribbon and take-up pancake is held at an absolute minimum. Consequently, a cartridge when modified with the disclosed drive has its requirement for driving torque held to an absolute minimum.

Yet another advantage of the disclosed device is that the ribbon drive relies on some take-up tension being supplied from the take-up pancake. Where take-up tension is absent, there is no ribbon advance at all. Consequently, if the drive belt to the take-up ribbon is absent, no ribbon passage occurs.

Yet another object is to disclose a single set of drive gears for enabling the manufacture of a cartridge which can be assembled in either a high speed single-strike or a low speed multi-strike configuration. According to this aspect, there is provided between the drive gear and the metering gear two co-axial gears preferably injection molded in a single piece. One gear is of small diameter and has a limited number of teeth. The remaining gear is of large diameter and has a relatively large number of teeth. By the expedient of placing the gear so as to increase the speed of the metering gear relative to that of the drive gear, high take-up speeds for single strike ribbon can be achieved. By the expedient of inverting the gear to a speed reduction format from the drive gear to the metering gear, low ribbon speed, as for multi-strike ribbon, can be achieved.

An advantage of this aspect of the invention is that multiple molds and resultant multiple gears for each particular type of single strike or multi-strike ribbons are not required.

A further object of this invention is to enable the drive of this invention to be tailored to any desired ribbon speed. According to this aspect of the invention, the metering gear is designed to be fitted with variant sizes of rubber cylinders. The external surface of these rubber cylinders is thus given various diameters for various ribbon speeds. Consequently by changing the outer diameter of the rubber cylinder, the disclosed ribbon drive can be tailored to virtually any speed that the parameters of the ribbon or printer require.

In accordance with another embodiment of this invention, a plurality of drive cylinders can be used, all for driving the same ribbon.

In accordance with yet another embodiment of this invention, two or more cylinders having one or more belts threaded around them may be utilized. In this embodiment, the ribbon is frictionally metered by the belts, with frictional traction effected by wrapping the ribbon over the outer surfaces of the belts as they pass around one or more of the cylinders. This embodiment may be used in an arrangement providing take-up tension, as with the wrapped cylinder drive disclosed above. Alternatively, with this embodiment the ribbon may be pinched between the belt and a fixed surface or roller in the area where the belts span the gap between the cylinders. The high friction of the belt against the ribbon overcomes the relatively low friction of the ribbon against the fixed surface or roller, providing a tractive force on the ribbon. When amplified by the wrapping of the ribbon around the cylinder, this relatively small tractive force provides a large tractive force suitable for ribbon metering. Thus, this embodiment does not depend on a take-up pancake to provide take-up tension and therefore can be used for fabric or other ribbon cartridges where a take-up pancake is typically absent. In this latter embodiment, it will be noted that the elastic belts may be used as springs to provide the pinching force between the ribbon and the fixed surface or roller.

BRIEF DESCRIPTION OF THE DRAWINGS

Other objects, features, and advantages of this invention will be more apparent after referring to the following specification and attached drawings in which.

DESCRIPTION OF THE PRIOR ART

Figure 1:
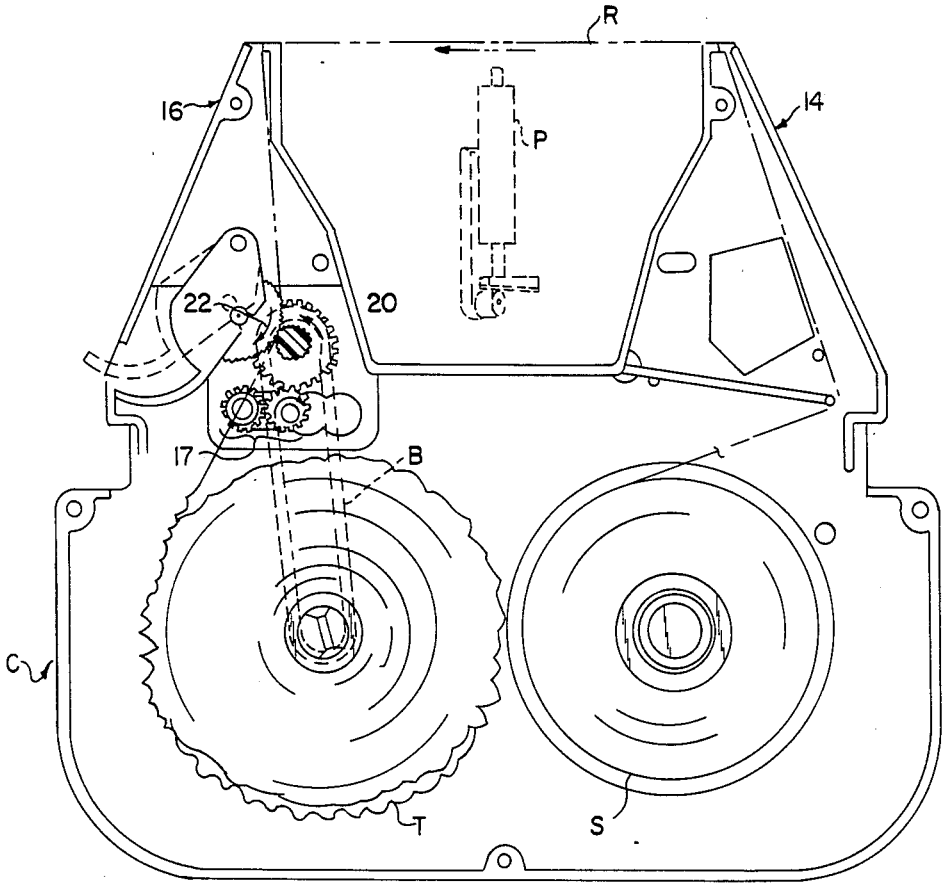
FIG.1 (PRIOR ART)
FIG. 1 is a view of a prior art cartridge illustrating the difficulties of the prior art.

Referring to FIG. 1 the cartridge and drive gear arrangement claimed and described in Daughters U.S. Pat. No. 4,307,969 issued Dec. 29, 1981 and Daughters U.S. Pat. No. 4,400,103 issued Aug. 23, 1983 is disclosed. The reader will understand that the improved drive gear allowing universal adoption of the cartridge there shown may likewise be used here. The improvement herein set forth is the metering capability of the ribbon.

Referring to FIG. 1, a prior art cartridge C is shown having a supply ribbon pancake S and a take-up ribbon pancake T mounted in the interior of the cartridge. Ribbon R passes out a ribbon supply arm 14 across a printer strike head P and to a ribbon take-up arm 16.

In the prior art, drive gears 17 drove confronting metering gears 20, 22. Ribbon R passed between and was folded in a serpentine configuration by the confronting teeth of the confronting gears 20, 22. Gears 20, 22 were typically forced together by springs.

When ribbon R passed to take-up pancake P1, the ribbon was disposed in both a folded and a spiral pattern.

Generally take-up pancake T limits the capacity of prior art ribbons. This is because the ribbon is given a folded configuration by confronting gears 20, 22. This folded configuration is then spirally wound on take-up pancake T, always to a larger diameter than that which appeared at supply ribbon pancake S.

The reader will also realize that when initial dispensing of ribbon occurs, supply pancake S will be large and take-up pancake T will be small. Take-up pancake is driven by a belt B (shown in broken lines). Typically, when take-up initially occurs, the diameter of the take-up pancake T is small, the take-up tension correspondingly large, and ribbon rapidly advances between gears 20, 22.

Where, however, the cartridge is at the end of its life and take-up pancake T is large, the torque provided by belt B to the take-up pancake T produces a small tension in the ribbon. Consequently, the rate of ribbon advanced is decreased.

It will also be understood that the actual path of the ribbon between the gears will be serpentine. This serpentine path will vary both in length and in distance from the centers of the meshing gears. These variations in length and distance can either independently occur and/or can be responsive to variations in ribbon tensions. Consequently, the rate at which the ribbon is metered can and does vary.

Having set forth the prior art, the new drive provided by this invention will now be set forth.

Figure 2:
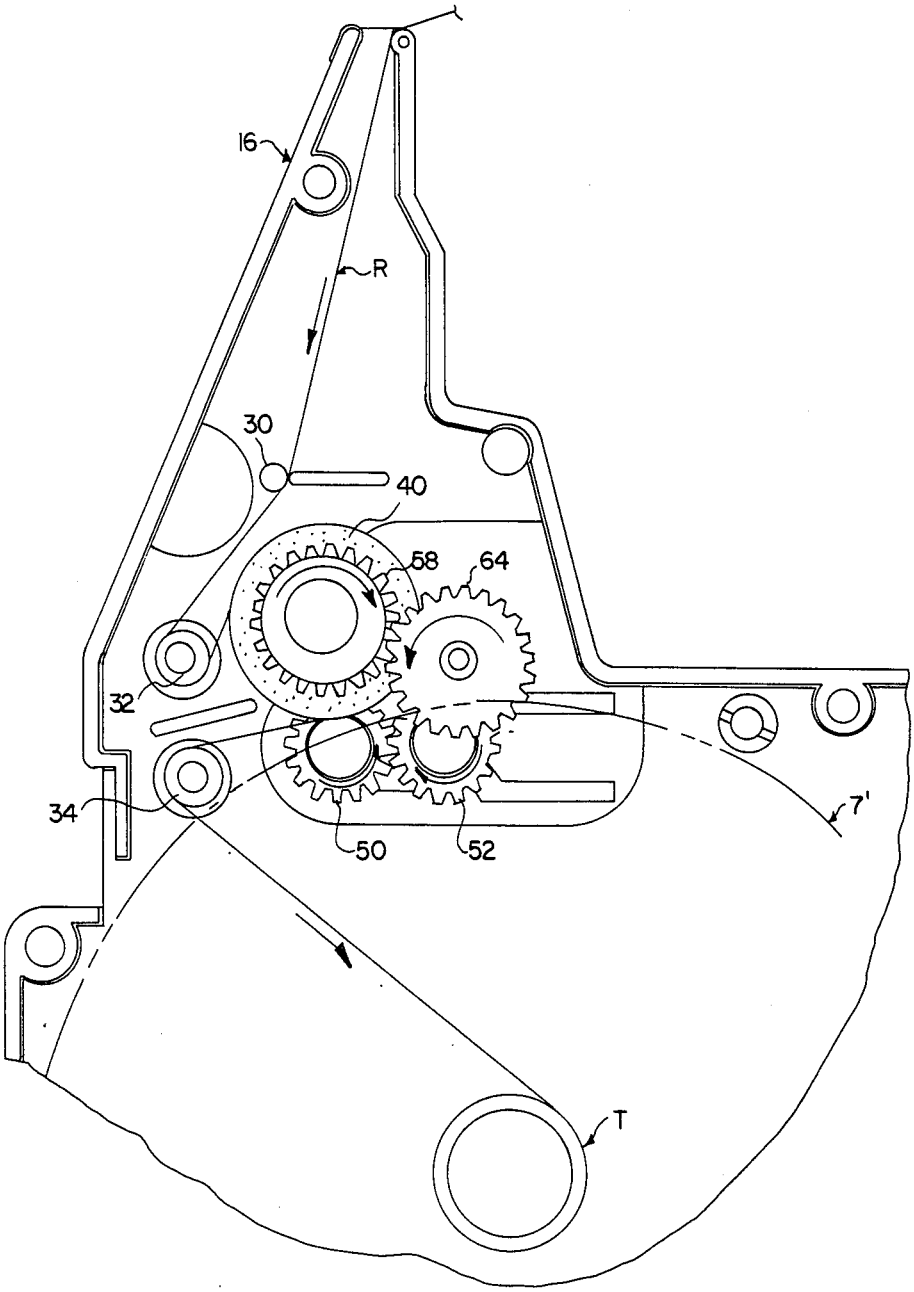
FIG. 2 is a plan view of the cartridge illustrated in FIG. 1 with the drive herein disclosed incorporated for driving a ribbon at a speed for single strike.

Referring to FIG. 2, the improvement of this invention can be seen. Specifically, a take-up arm 16 effects take-up to a take-up ribbon pancake T. Pancake T winds ribbon from an initial and small pancake size T to a final and larger pancake size T.

The ribbon path occurs over a post 30 having a low coefficient of friction surface permitting the ribbon to pass. Thereafter, the ribbon passes around an idler pulley 32 to a take-up cylinder or metering cylinder 40. The ribbon wraps around metering cylinder 40, passes to an idler pulley 34 and then to the take-up pancake T.

A first drive gear 50 and a second drive gear 52 are arranged in Daughters U.S. Pat. No. 4,307,969 issued Dec. 29, 1981 and Daughters U.S. Pat. No. 4,400,103 issued Aug. 23, 1983. Specifically, drive gear 50 meshes with drive gear 52.

Figure 3:
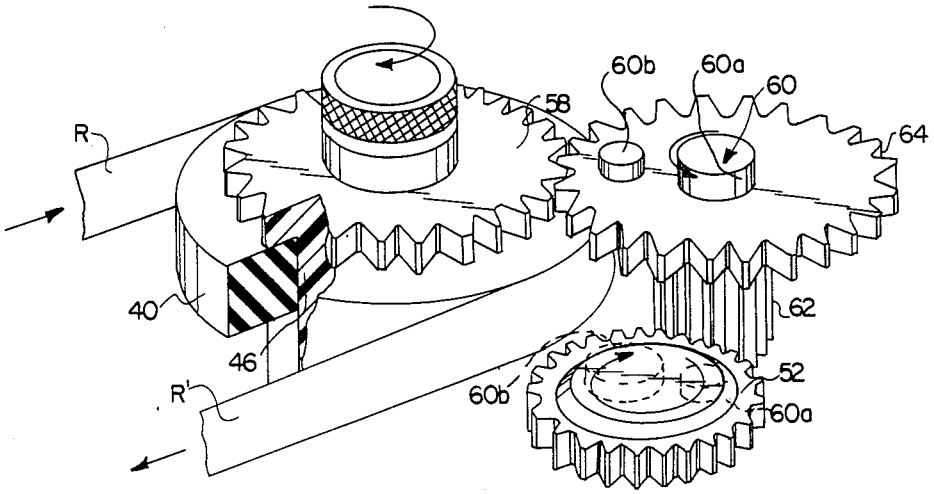
FIG. 3 is a drive gear arrangement for high speed ribbon metering for use in a single strike cartridge, the drive here shown with a reversible gear.
Figure 4:
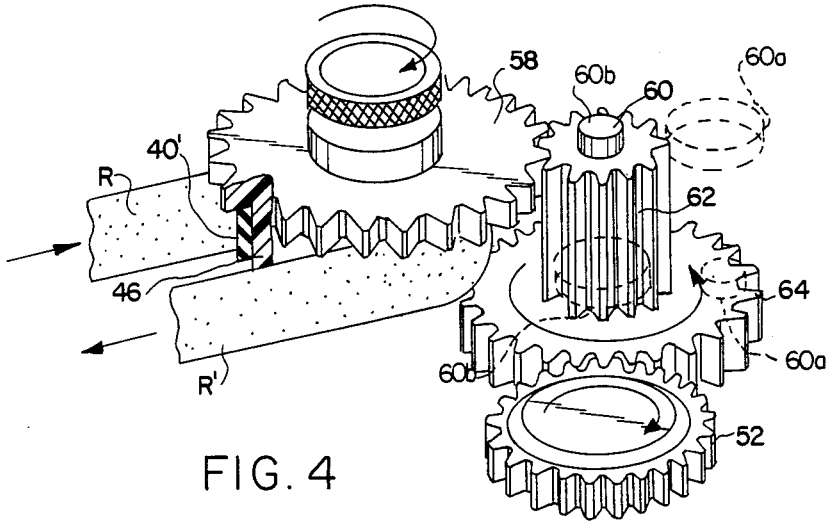
FIG. 4 is the drive gear arrangement of FIG. 3 altered for low speed ribbon metering for use in a multi-strike cartridge, the drive here shown with the intermediate drive gear reversed.

Referring to FIG. 2 and FIG. 3. ribbon R is wound over the metering cylinder 40. Referring specifically to FIG. 3, metering cylinder 40 is driven at gear 58 by gear assembly 60. As will be more clearly specified with respect to FIG. 4, gear assembly 60 is reversible and can be mounted in one of two locations in the cartridge. When in the configurations shown in FIG. 3, gear assembly 60 drives ribbon R at a relatively high rate of speed for a single strike capability. When in the configuration shown in FIG. 4, gear assembly 60 drives ribbon R at a relatively low rate of speed for a multi-strike capability. As the differences in the configurations between FIG. 3 and FIG. 4 are explained the reader will understand that by assembling the cartridge with the gear assembly 60 reversed, and in a different location, the rate of rotation of metering cylinder 40 changes. Finally, it will be emphasized that by threading the metering cylinder with a rubber cylinder of differing diameter, the rate of ribbon advance for virtually all types of ribbon and printer configurations can easily be tailored.

Referring to FIG. 3, ribbon take-up drive gear 52 drives gear assembly 60 at small diameter gear 62 at journal **60*a*. Gear 62 rotates gear 64 which in turn drives gear 58. Gear 58 powers metering cylinder 40 which is threaded onto a lower extension 46 of gear 58. As shown in both FIG. 2 and FIG. 3, metering cylinder 40** has a large diameter for passing ribbon R at a high rate of speed for single strike capability.

Referring to FIG. 4, gear 52 drives gear assembly 60 at large diameter gear 64. Gear 64 rotates small diameter gear 62 which in turn drives gear 58. Gear 58 powers metering cylinder 40' which is threaded onto a lower extension 46 of gear 58. As shown in FIG. 4, metering cylinder 40' has a small diameter for passing ribbon R at a low rate of speed for multi-strike capability. It will, of course, be realized that in order to achieve this alternate drive capability, gear assembly 60 must be mounted in an alternate location at journal **60*b*** from that shown in FIG. 2 and FIG. 3.

Figure 6:
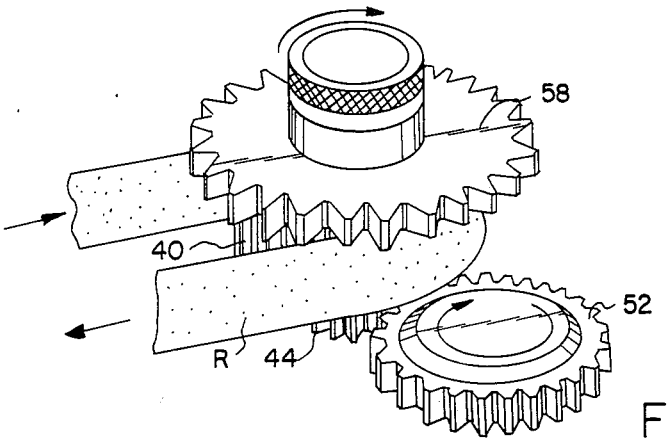
FIG. 6 is a drive with a customized drive gear which turns the metering cylinder at high speed for a single strike operation.
Figure 5:
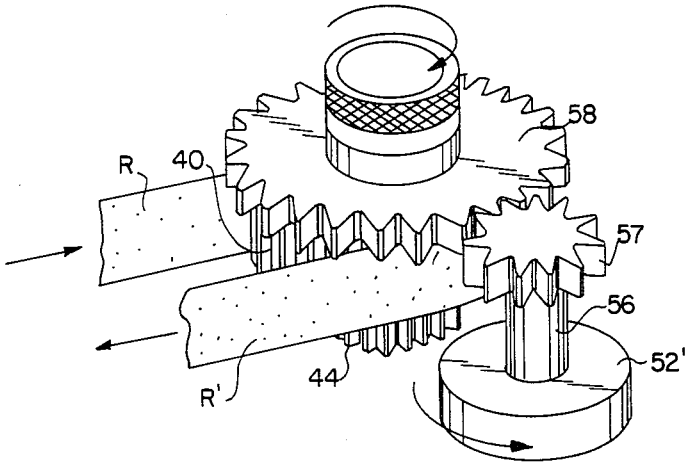
FIG. 5 is a drive with a customized drive gear which turns the metering cylinder at low speed for multi-strike operation.

It can be seen with respect to FIG. 5 and FIG. 6 that direct drive of the metering cylinder can occur from the drive of the printer.

Referring to FIG. 5, wheel 52' is illustrated, differing from the drives of FIGS. 2, 3, and 4 in that the gear teeth are removed. An upstanding and rotating shaft 56 from wheel 52' rotates gear 57. Gear 57 drives gear 58, and gear 58 powers metering cylinder 40 which is threaded onto a lower extension of gear 58. The ribbon here passes at a relatively slow speed suitable for multi-strike ribbon.

Referring to FIG. 6, gear 52 is shown driving small gear 44 at the bottom of metering cylinder 40. This simple arrangement allows for high speed passage of the ribbon R as is required for single strike ribbon.

Stopping here, an advantage of this drive can be understood. Specifically, and referring to FIG. 1, it will be remembered that belt B is exterior to the drive assembly. Being exterior to the drive assembly, this belt can become detached from the ribbon. Where the belt becomes detached from the ribbon, it will be understood that ribbon out R′ will have no tension thereon. When ribbon R′ has no tension, metering cylinder 40 typically will not grasp ribbon R. Thus, the cartridge will cease to meter ribbon. This will prevent the tape from accumulating and causing the cartridge to jam.

Figure 7:
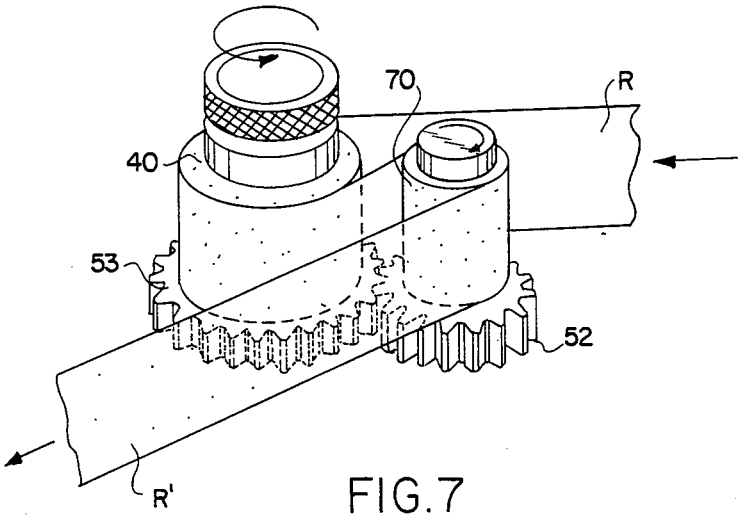
FIG. 7 is a drive with two metering cylinders.

It should be apparent to the reader that more than one winding pulley could be utilized for this invention. Referring to FIG. 7, such an embodiment is illustrated.

Specifically, incoming ribbon R is wound around a first cylinder 40 and then around a second cylinder 70 on its way to the ribbon outpath R′. Cylinder 40 has gear 53 mounted thereon and cylinder 70 has gear 52 mounted thereon. The gear ratio between gear 52 and gear 53 is selected such that when gear 52 and gear 53 are meshed together, the speeds of the outside surfaces of cylinders 40 and 70 are the same.

The embodiment of FIG. 7 may be desirable where the surfaces 40, 70 are of a lower friction value with respect to the passing tape. Whereas, the rubber illustrated previously herein has a high coefficient of friction, it will be possible to accommodate materials with low coefficients of friction with the embodiment shown in FIG. 7, because the greater total angle of wrap around the two cylinders compensates for the lower coefficient of friction.

The embodiment of FIG. 7 may be driven by conventional means, or by the invertible coaxial gear discussed above.

Figure 8:
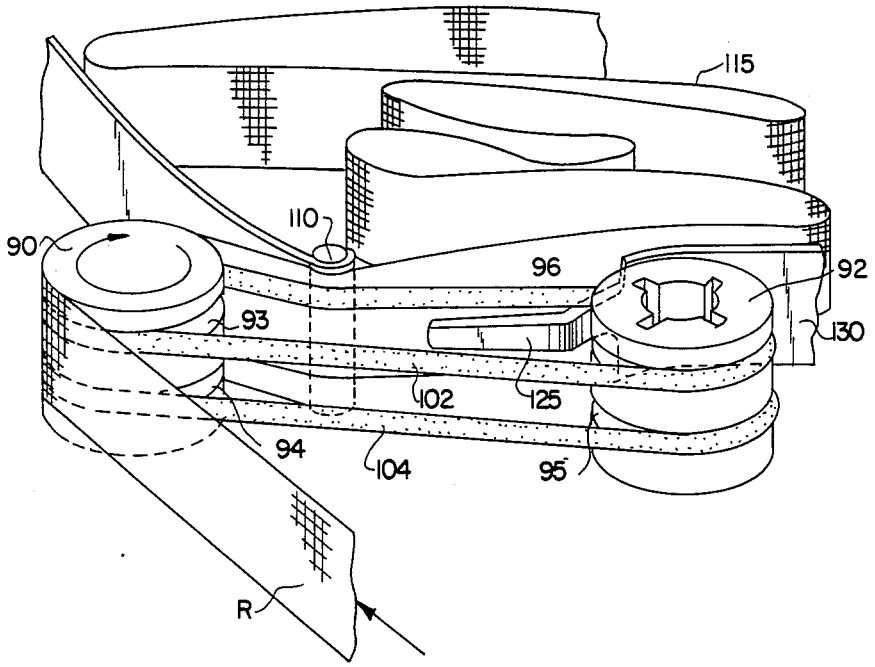
FIG. 8 is a perspective of an alternate embodiment of this invention utilizing paired metering cylinders interconnected by belts, with the belts entraining the ribbon.

Referring to FIG. 8 an alternate embodiment of this invention is illustrated. Specifically, first and second metering cylinders 90 and 92 are illustrated. These cylinders are provided with radial indentations 93, 94 in the case of cylinder 90 and 95, 96 in the case of cylinder 92.

The grooves are in turn threaded by respective belts 102, 104. The belts extend between the cylinders 90, 92. Therefore, a drive at one cylinder (not shown) is sufficient to power both cylinders.

Belts 102, 104, are crimped by a post 110 between the respective cylinders 90, 92. Post 110 urges the ribbon R into and against the rotating belts 102, 104. This effect may be readily understood.

Ribbon R threads around the exterior of cylinder 90. In such threading it passes over the outside surface of belts 102, 104. The ribbon then passes between the respective posts 110 and the belts 102, 104. Post 110 causes the ribbon to bear under friction against belts 102, 104.

It will be noted that the tension supplied by post 110 over the belt surfaces 102, 104 no longer requires tension from a take-up reel. Consequently, the ribbon may be gathered in fan folds as illustrated at 115.

There is a tendency for ribbon to continue to adhere to the outside of belts 102, 104. Therefore, a stripper assembly 125 is utilized. Stripper assembly 125 extends from ribbon cavity wall 130 between the belts 102, 104 adjacent the fan folded ribbon 115. Thus, ribbon adhering to the belts beyond posts 110 will be systematically stripped from the belts. It will be appreciated that other embodiments of this invention are possible.

What is claimed is:

1. An improved drive for a ribbon cartridge for placement in a printer, said ribbon cartridge including:

an enclosed housing;

a ribbon supply pancake spirally wound with ribbon;

a ribbon take-up pancake spirally wound with ribbon;

a ribbon supply arm;

a ribbon take-up arm;

a ribbon path from said ribbon supply pancake, out said ribbon supply arm, to and into said ribbon take-up arm, from said ribbon take-up arm to said ribbon take-up pancake;

a ribbon take-up drive gear for coupling to a motor on said printer;

means extending from said drive gear to said ribbon take-up pancake to provide said take-up ribbon pancake with ribbon tension; and, metering means for metering a rate of advance disposed between said ribbon take-up arm and said ribbon take-up pancake, the improvement in said metering means comprising:

a ribbon take-up cylinder mounted to permit said ribbon to be wound over the circumference of said take-up cylinder, said ribbon take-up cylinder mounted between said take-up arm and said take-up ribbon pancake;

means for winding said ribbon around said ribbon take-up cylinder whereby tension supplied by said ribbon take-up pancake to said ribbon take-up cylinder causes said ribbon take-up cylinder to exert belt pulley friction on said ribbon;

a first meshing gear for driving said ribbon take-up cylinder;

a second meshing gear operably connected to said ribbon take-up gear;

a coaxial transmission gear for mounting between journals for transmitting power from said ribbon drive gear to said ribbon take-up cylinder, said coaxial transmission gear including a first gear having a large diameter with a greater number of gear teeth and a second coaxial gear with a smaller diameter and a lesser number of teeth than said first gear;

first and second pairs of journals at first and second different non-coaxial locations on said housing for mounting said coaxial gear to mesh with said first and second meshing gears further including one of: means for feeding the ribbon at a slow speed including said coaxial transmission gear rotationally mounted in said first pair of journals with said first gear in engagement with said first meshing gear and said second gear in engagement with said second meshing gear;

means for feeding the ribbon at a fast speed including said coaxial transmission gear rotationally mounted in said second pair of journals with said first gear in engagement with said second meshing gear and said second gear in engagement with said first meshing gear.

* * * * *